United States Patent [19]

Rudszinat

[11] 4,255,998

[45] Mar. 17, 1981

[54] APPARATUS FOR CUTTING PAPER WEBS OR THE LIKE

[75] Inventor: Willy Rudszinat, Dassendorf, Fed. Rep. of Germany

[73] Assignee: Hauni-Werke Körber & Co. KG, Hamburg, Fed. Rep. of Germany

[21] Appl. No.: 953,964

[22] Filed: Oct. 23, 1978

[30] Foreign Application Priority Data

Nov. 3, 1977 [DE] Fed. Rep. of Germany ..... 2749174

[51] Int. Cl.[3] ..... B26D 5/24; A24C 5/28

[52] U.S. Cl. ..... 83/298; 83/299; 83/324

[58] Field of Search ..... 83/38, 298, 299, 324, 83/76

[56] References Cited

U.S. PATENT DOCUMENTS

| | | | |
|---|---|---|---|
| 1,997,608 | 4/1935 | Swift, Jr. | 83/324 X |
| 2,023,851 | 12/1935 | Nehlsen | 83/76 |
| 2,215,762 | 9/1940 | Morrison | 83/324 X |
| 2,244,673 | 6/1941 | Bruker | 83/311 X |
| 2,879,845 | 3/1959 | Haas | 83/324 X |
| 3,048,751 | 8/1962 | Taylor | 83/76 X |
| 3,071,999 | 1/1963 | Thorn | 83/76 |
| 3,181,403 | 5/1965 | Sterns et al. | 83/76 |
| 3,232,157 | 2/1966 | McMath et al. | 83/76 |
| 3,742,798 | 7/1973 | Gries | 83/324 X |
| 3,745,865 | 7/1973 | Johnson | 83/324 X |
| 3,962,942 | 6/1976 | Ferara | 83/324 X |

*Primary Examiner*—J. M. Meister
*Attorney, Agent, or Firm*—Peter K. Kontler

[57] ABSTRACT

Apparatus for subdividing a running paper web into sections of desired length has a first motor which drives the web at a constant speed and a D.C. motor which drives an orbiting knife at a speed which varies during each angular movement of the knife through 360 degrees. A detector which monitors the speed of the web transmits signals which are utilized to insure that the speed of the knife matches the speed of the web during that stage of each orbital movement when the knife cuts the web. The length of intervals between successive cutting operations is adjustable by connecting the knife with any one of several graduated disks whose graduations are monitored by a second detector which controls the speed of the knife during intervals between successive cutting operations. The disks have first sets of equidistant graduations which are monitored by the second detector while the knife approaches, cuts and moves away from the running web, and second sets of graduations which are monitored by the second detector while the knife moves away from and back toward the web. The distribution of graduations of the second set on each disk is different. The D.C. motor is respectively accelerated and decelerated when the spacing between neighboring graduations on the selected disk respectively increases and decreases.

7 Claims, 1 Drawing Figure

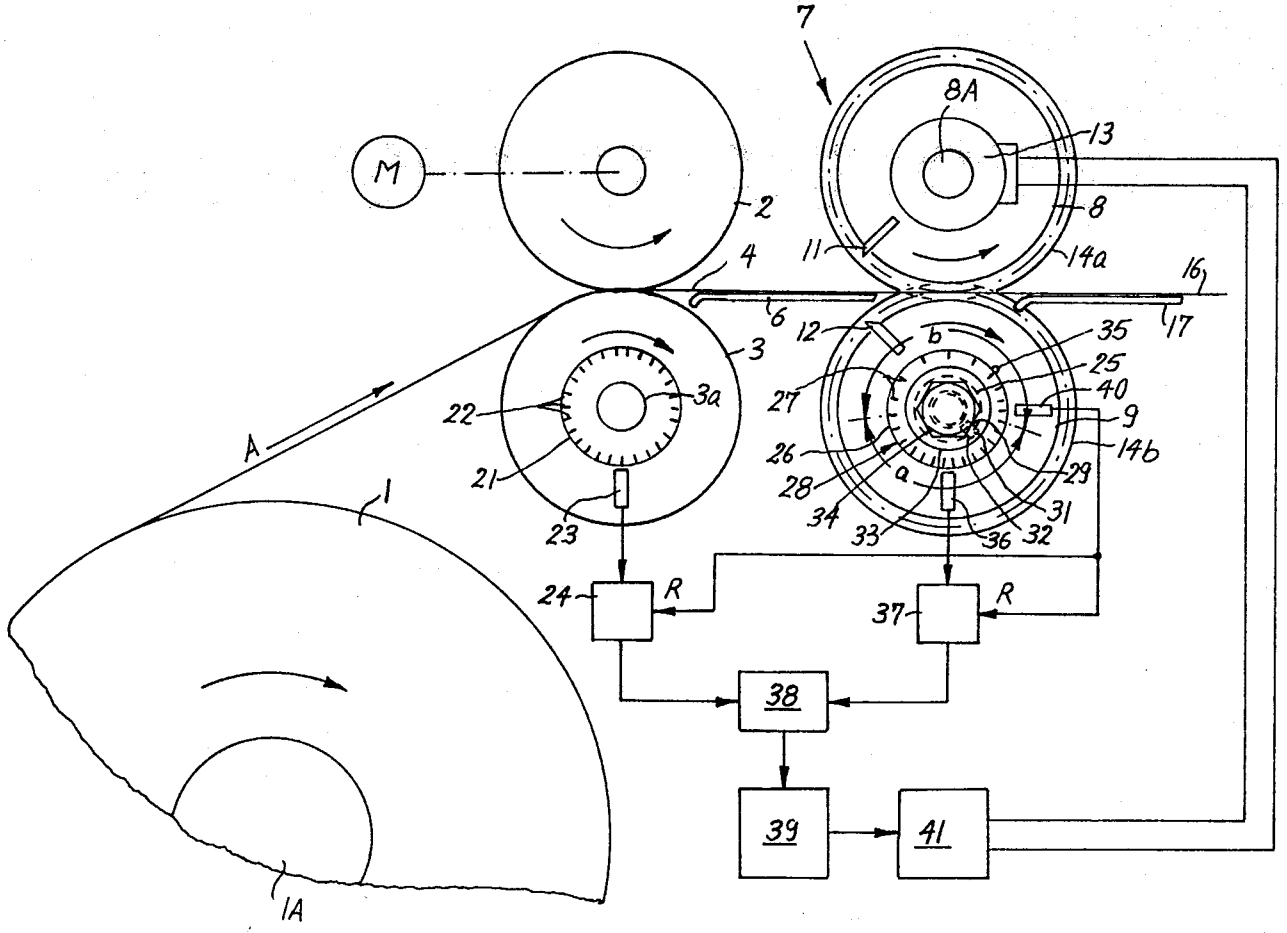
7
13
8A
8
14a
11
16
17
6
4
2
M
3
3a
22
21
23
24
R
R
35
25
40
9
14b
29
31
32
36
b
a
12
27
26
28
34
33
37
38
39
41
A
1
1A

APPARATUS FOR CUTTING PAPER WEBS OR THE LIKE

CROSS-REFERENCE TO RELATED APPLICATION

The apparatus of the present invention serves the same purpose as the apparatus which is disclosed in my copending application Ser. No. 954,093 filed October 24, 1978 for "Apparatus for subdividing running webs into sections of varying length".

BACKGROUND OF THE INVENTION

The present invention relates to apparatus for subdividing running webs into sections of desired length. More particularly, the invention relates to improvements in apparatus for cutting running continuous paper webs or the like by means of one or more orbiting knives.

Apparatus wherein a knife orbits adjacent to the path of a running web to sever the web once during each orbital movement through 360 degrees are known as concurrent transverse cutters. In such apparatus, the speed of movement of the knife along its endless path equals the speed of lengthwise movement of the web, and the knife advances in the direction of movement of the web during travel through the cutting or severing station. A drawback of presently known concurrent transverse cutters is that each adjustment or conversion of the apparatus from severing of sections having a first length to severing of sections having a different length involves several operations which normally include replacement or adjustment of several components of the cutting or severing mechanism proper, adjustment or replacement of the transmission which drives the knife or knives, and/or adjustment or replacement of advancing means for the web. Such operations consume much time and must be carried out by skilled attendants.

Subdivision of a running web which consists of paper, cardboard, metallic material and/or synthetic plastic material is necessary in several branches of the tobacco processing industry. For example, each filter tipping machine for cigarettes, cigars or cigarillos comprises a cutting device which subdivides an adhesive-coated running web of cigarette paper, imitation cork or like material into discrete bands which are used to unite filter mouthpieces with plain cigarettes, cigars or cigarillos. Furthermore, packing machines for cigarettes or the like employ cutters which subdivide running webs of paper, cardboard or metallic or plastic foil into discrete blanks, and such blanks are thereupon converted into components of packs for smokers' products, e.g., on one or more indexible turrets of the packing machine. Still further, cutting devices are used extensively in many branches of paper processing industry, for example, to subdivide a relatively wide or a relatively narrow running paper web into smaller sections which are thereupon accumulated into layers or stacks to form part of note books, pads or analogous stationery products.

In each of the above-enumerated and many other industries, the cutting apparatus must be frequently converted to furnish sections or blanks of a different length. For example, the dimensions of adhesive-coated uniting bands must be changed when a filter tipping machine is to be converted to turn out a different brand of cigarettes. Also, a packing machine must be converted, from time to time, to make packs for shorter or longer smokers' products; this entails an adjustment of the cutting apparatus so that the latter converts running webs into longer or shorter blanks. Still further, such cutting apparatus must be adjusted when they are used to subdivide a ribbon of revenue labels into discrete labels which are applied to cigarette packs or the like. When the rules or provisions of customs authorities change, the manufacturer must apply differently dimensioned and/or colored labels. In the paper processing industry, conversion from the making of shorter sections (e.g., sheets or leaves) to the making of longer sections or vice versa is necessary when the manufacturer must change the setup from the manufacture of a first type of products (e.g., large note books) to the manufacture of a second type of products (e.g., small pocket calendars or the like). In each instance, the owner of the cutting apparatus desires to complete the conversion within a short interval or time and with a minimum of outlay for skilled labor and/or spare parts.

OBJECTS AND SUMMARY OF THE INVENTION

An object of the invention is to provide a novel and improved cutting apparatus for running paper webs or the like which is constructed and assembled in such a way that it can be rapidly converted from subdivision of a continuously running web into relatively short sections or blanks into longer sections or blanks and vice versa.

Another object of the invention is to provide a cutting apparatus wherein the conversion involves a minimal number of steps and the conversion to the making of any one of a large number of differently dimensioned sections does not necessitate the utilization of a large number of bulky, complex and expensive spare parts or components.

A further object of the invention is to provide a cutting apparatus of the above outlined character wherein the conversion does not involve any adjustment or replacement of component parts of the cutting mechanism proper and/or of the transmission or transmissions which impart motion to driven elements of the apparatus.

An additional object of the invention is to provide a cutting apparatus which can be converted from the making of shorter sections to the making of longer sections or vice versa by resorting to semiskilled or unskilled labor.

An ancillary object of the invention is to provide the apparatus with novel and improved means for driving the cutting unit.

The invention is embodied in an apparatus for subdividing a running web of paper, cardboard, metallic foil, synthetic plastic foil or the like into sections (e.g., labels, uniting bands or blanks) of desired length. The apparatus comprises means (e.g., two driven rolls and a motor which drives at least one roll) for advancing the web lengthwise along a first path at a predetermined speed (preferably at a constant speed), rotary cutter means including at least one knife orbiting along an endless second path a portion of which is adjacent the first path so that the knife makes a cut transversely across the running web while moving along such portion of the second path whereby the web yields a succession of sections whose length is a function of the duration of intervals which elapse between successive movements of the knife along the aforementioned portion of the second path, a D.C. motor or another suitable variable-speed prime mover for the cutter means, control means for varying the speed of the prime mover during each revolution of the cutter means so as to drive the knife at a first speed which matches the (predetermined) speed of the web while the knife moves along the aforementioned portion of the second path and at any one of a plurality of different second speeds while the knife moves from and back to the aforementioned portion of the second path, and means for adjusting the control means so as to select the second speed and hence the duration of aforementioned intervals.

The control means preferably comprises means for generating first signals denoting the speed of the running web and means for maintaining the speed of orbital movement of the knife in the aforementioned portion of the second path at such predetermined speed in response to the first signals. For example, the frequency at which the first signals are generated may be indicative of the speed of lengthwise movement of the web.

The aforementioned maintaining means may comprise means for respectively generating second and third signals during movement of the knife along the aforesaid portion of the second path and along the remaining portion of the second path. The second signals depend from the first signals and such maintaining means further includes means for regulating the speed of the prime mover as a function of the second and third signals. The adjusting means the comprises means for varying the third signals.

In accordance with a presently preferred embodiment of the invention, the means for generating first signals comprises a rotary element (e.g., a graduated disk consisting of glass) having equidistant indicia, means (e.g., the shaft of one of the aforementioned rolls of the advancing means for the web) for rotating the element at a speed which is proportional to the speed of the web, and a photocell or other suitable signal generating detector means which monitors the indicia on the disk and transmits first signals at a constant frequency (as long as the speed of the web is constant). The means for generating the second and third signals then comprises a second rotary element having a first set of equidistant indicia and a second set of indicia, means for rotating the second element in synchronism with the cutter means, and transducer means which monitors the indicia on the second element and respectively transmits second and third signals on detection of indicia of the first and second sets. The adjusting means in an apparatus of the just outlined character may comprise at least one spare second rotary element whereon the distribution of the second set of indicia is different and means for separably coupling the first mentioned second element to the cutter means to allow for rapid replacement of such element with the spare element.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a partly elevational and partly diagrammatic view of an apparatus which embodies the invention and wherein one of two rotary cutters of the cutting means is directly driven by a variable-speed electric motor.

DESCRIPTION OF THE PREFERRED EMBODIMENTS

The apparatus which is shown in the drawing comprises a frame which supports a spindle 1A for a bobbin 1 constituting a source of web 4. The web 4 consists of paper, cardboard or metallic or plastic foil. The path along which the web 4 is moved in the direction of arrow A by two advancing rolls 2, 3 is defined in part by elongated guides 6 and 17 which flank a severing or cutting unit 7. The severing unit 7 comprises two cutters which respectively include rotary holders 8 and 9 for orbiting knives or blades 11 and 12. The shaft 8A of the upper holder 8 (as viewed in the drawing) is driven directly by the output element of a variable-speed prime mover here shown as a D.C. motor 13 in such a way that the angular speed of the holder 8 fluctuates during each revolution. The holder 9 is driven at the speed of the holder 8 by two mating gears **14*a*, 14*b* which are respectively affixed to the shafts 8A and 25. The knives 11 and 12 sever the web 4 once during each revolution of the holders 8, 9, and the resulting sections or blanks 16 advance along the guide 17 on to a further processing station, not shown. For example, the sections 16 can be coated with adhesive to constitute bands which are used in a filter tipping machine to unite filter plugs with plain cigarettes of unit length. Alternatively, the sections 16 may constitute blanks which are transported to a cigarette packing machine to be converted into inner, median or outer envelopes of cigarette packs. Still further, the sections 16** may constitute sheets or leaves which are fed to a suitable stacker to form piles of sheets which are to be converted into note books or the like.

Those portions of the endless path for the knives 11 and 12 along which the knives 11, 12 move during severing of the running web 4 are respectively located at the six and twelve o'clock positions of the corresponding holders 8, 9. The speed of the knives 11, 12 varies while the knives move from and back to the cutting or severing station, and the duration of intervals which elapse between successive movements of the knives into severing engagement with the web 4 determines the length of sections 16.

The shaft **3*a* of the advancing roll 3 carries one component of a signal generating means which transmits first signals at a frequency proportional to the speed of lengthwise movement of the web 4 through the nip of the rolls 2, 3. This component is a rotary element here shown as an indicia-bearing disk 21 having indicia in the form of radially extending graduations 22 which are monitored by a detector 23 having an output connected to the corresponding input of a first counter 24. The disk 21 may consist of glass; such disks can accommodate a large number of graduations in a small area (e.g., 100 or more per mm). For example, the graduations 22 can be formed by etching; they are equally spaced from each other, as considered in the circumferential direction of the disk 21. The detector 23 may constitute a photocell or any other suitable means which can transmit eletric signals at the frequency of movement of successive graduations 22** therealong.

The shaft 25 of the holder 9 carries one component of a second signal generating means. This component is also a rotary element here shown as an indicia-bearing disk 26 which is detachably mounted on the shaft 25.

The material of and the mode of applying radially extending graduations or indicia 27 to the disk 26 are preferably the same as described in connection with the disk 21. The disk 26 comprises a zone a wherein the distribution of a first set of graduations 27 is identical with the distribution of graduations 22 of the disk 21. The remaining zone b of the disk 26 carries a second set of graduations 27 whose distribution deviates from that of graduations 27 in the zone a. The spacing between graduations 27 in the zone b may be greater (this is shown in the drawing) or smaller than the distances between the graduations 27 in the zone a. A photocell 36 or another suitable transducer monitors successive graduations 27 and transmits second and third signals which are used to regulate the speed of the motor 13 for the holder 8. The arrangement is such that the motor 13 drives the holders 8 and 9 at a peripheral speed which matches the speed of lengthwise movement of the web 4 through the nip of the holders 8 and 9 while the knives 11 and 12 approach, sever and move slightly beyond the adjacent portion of the running web 4. In the embodiment which is shown in the drawing, the spacing of graduations 27 in the zone b of the disk 26 gradually increases at both sides of the zone a to reach a maximum value diametrically opposite the center of the zone a. In other words, the spacing increases gradually from one side of the zone a toward the center of the zone b and thereupon decreases gradually toward the other side of the zone a. This insures that the speed of the motor 13 does not undergo any abrupt changes when the transducer 36 begins to monitor the graduations 27 in the zone a or b during each revolution of the disk 26.

The means for adjusting the control means including the two signal generating means 21–23 and 26, 27, 36 comprises quick-release coupling means 28 for the disk 26. The coupling means 28 comprises a groove 29 in the shaft 25, a tongue 31 in the groove 29, a complementary groove 32 for a portion of the tongue 31 in the internal surface of the disk 26, a washer 33 which overlies the central portion of the disk 26, and a screw 34 whose shank extends into a tapped bore in the end face of the shaft 25. Thus, by removing the screw 34, an operator can immediately detach the disk 26 and replace it with a disk having a zone b with a set of graduations whose distribution is different from that of the set of graduations in the zone b of the detached disk. The tongue 31 insures accurate orientation of each disk 26 with respect to the knives 11 and 12.

The output of the detector 36 transmits the second and third signals to a second counter 37. The counters 24 and 37 have resetting inputs R which are connected with a proximity detector 40. The latter is adjacent to the periphery of the disk 26 and transmits a resetting signal whenever approached by a protuberance 35 of the disk 26. It goes without saying that such protuberance is provided on each and every disk 26.

The outputs of counters 24, 37 transmit signals to a signal comparing stage 38 which transmits a proportional voltage signal to a regulating circuit 39. The polarity of voltage signals which are transmitted by the stage 38 depends on the extent to which the intentsity of signal from the counter 24 (denoting the number of first signals transmitted by the detector 23 per unit of time) exceeds the intensity of signal from the counter 37 (such signal denotes the number of signals transmitted by transducer 36 per unit of time). The circuit 39 transmits appropriate signals to the motor 13 via operational amplifier 41. The amplifier 41 is preferably a four-quadrant amplifier (e.g., type 115 produced by the firm Lenze, Hameln, Federal Republic Germany) which can supply voltage to drive the D.C. motor 13 as well as accept voltage which is generated by the motor 13 when the latter acts as a generator during braking. The motor 13 may be of the type SNG 632 h, also produced by Lenze. The polarity of the output signal which is transmitted by the stage 38 is selected in such a way that, when the intensity of signal furnished by the output of the counter 24 exceeds the intensity of signal at the output of the counter 37, the regulating circuit 39 causes the amplifier 41 to accelerate the motor 13. Inversely, the stage 38 transmits a signal of opposite polarity when the intensity of signal at the output of counter 37 exceeds the intensity of signal at the output of counter 24. The circuit 39 then causes the amplifier 41 to brake the motor 13.

The parts 21–27 and 36–41 can be said to constitute a control unit which varies the speed of the motor 13 during each revolution of the cutters 8, 11 and 9, 12 so as to drive the knives 11, 12 at a first speed which matches the speed of the web 4 while the knives move along the path for the web and at any one of a plurality of different second speeds while the knives 11, 12 move away from and back to the cutting or severing station. The purpose of the adjusting means 28 (parts 29–34) is to select the second speed of the cutters and hence the duration of intervals which elapse between successive cutting operations.

The operation is as follows:

The advancing rolls 2 and 3 are driven at a constant speed by a motor M so that the web 4 is transported at a constant speed toward the nip of the knife holders 8 and 9. The knives 11, 12 cooperate to sever the web 4 once during each revolution and the thus obtained sections 16 of the web advance along the guide 17 on to the next processing station. While the knives 11 and 12 sever the web 4, the protuberance 35 of the disk 26 travels past the proximity detector 40 which transmits resetting signals to the inputs R of the counters 24 and 37 so that each of these counters is reset to zero.

The counter 24 receives signals from the photocell 23 in response to travel of successive graduations 22 past the monitoring station in the six o'clock position of the rotating disk 21. The counter 37 receives signals from the transducer 36 in response to travel of successive graduations 27 past the monitoring station at the six o'clock position of the rotating disk 26. If the number of signals which the counter 37 receives per unit of time is temporarily less than the number of signals transmitted to the counter 24 during the same unit of time, the stage 38 transmits to the regulating circuit 39 a signal which causes the amplifier 41 to accelerate the motor 13. In other words, the signal generating means including the disk 21, its graduations 22 and the photocell 23 causes the motor 13 to increase the peripheral speed of the knife holders 8, 9. When the number of signals transmitted to the counter 37 per short unit of time temporarily exceeds the number of signals which the counter 24 receives from the photocell 23 during the same short unit of time, the stage 38 transmits to the circuit 39 a signal which causes the amplifier 41 to decelerate the motor 13. The number of signals which the counter 24 receives per longer unit of time is the same as that received by counter 37.

When the zone a of the disk 26 has advanced beyond the transducer 36, i.e., when a severing operation is completed, the spacing between neighboring graduations 27 in the zone b of the disk 26 begins to increase, i.e., the number of signals which the counter 24 receives per short unit of time begins to exceed the number of signals which are received by the counter 37 during the same short unit of time. Therefore, the stage 38 transmits a signal which causes the regulating circuit 39 and amplifier 41 to accelerate the motor 13. The acceleration proceeds until the spacing between neighboring graduations 27 in the zone b of the disk 26 begins to decrease so that the number of signals which the counter 37 receives per short unit of time exceeds the number of signals which the counter 24 receives from the photocell 23 during the same short unit of time. Therefore, the amplifier 41 decelerates the motor 13 and the deceleration is terminated when the transducer 36 begins to monitor the graduations 27 in the zone a of the disk 26. At such time, the speed of motor 13 is sufficiently low to insure that the peripheral speed of knife holders 8 and 9 matches the speed to lengthwise movement of the web 4. Since the spacing of graduations 22 on the disk 21 equals the spacing of graduations 27 in the zone a of the disk 26, the speed of the motor 13 remains constant as long as the transducer 36 generates signals in response to detection of graduations 27 in the zone a of the disk 26. This amounts to a follow-up control of operation of the motor 13. The knives 11 and 12 sever the web 4 while the peripheral speed of the holders 8, 9 matches the speed of the web 4; therefore, each cut transversely across the web 4 is a clean cut. The protuberance 35 resets the counters 24, 37 to zero at the time when the knives 11, 12 complete a severing operation. The aforedescribed sequence of steps is thereupon repeated, i.e., the motor 13 is accelerated at a constant rate, thereupon decelerated at a constant rate and rotates the holder 8 at a constant speed when the knives 11 and 12 return to the severing station at the nip of the holders 8 and 9. It will be seen that the peripheral speed of the holders 8 and 9 fluctuates during each revolution, namely, the speed is constant during severing of the web 4 and thereupon gradually increases and gradually decreases to again match the speed of lengthwise movement of the web 4 in the course of the next-following severing operation.

If the operator desires to change the length of sections 16, i.e., the distance between successive cuts across the running web 4, the screw 34 is removed to allow for detachment of the disk 26. This disk is thereupon replaced with a disk having graduations 27 in a distribution other than that of graduations on the removed (illustrated) disk 26. The distribution of graduations 27 in the zone a of the freshly inserted disk 26 is the same as that on the removed disk; however, the distribution of graduations in the zone b of the freshly inserted disk 26 is different. Therefore, the rate at which the speed of the motor 13 changes during travel of zone b past the transducer 36 also changes but the speed of the knives 11 and 12 during severing is the same as during severing prior to replacement of the illustrated disk 26. The difference is that the interval of time which elapses between two successive severing operations with the new disk 26 on the shaft 25 is longer or shorter than prior to detachment of the illustrated disk 26. Thus, the operator can select any desired intervals between successive severing operations by the simple expedient of selecting the appropriate disk 26 and installing such disk in lieu of the previously used disk 26. The transmission 14*a*, 14*b*, the motor 13, the cirucitry, the motor M for the advancing rolls 2, 3 and/or other parts of the apparatus need not be replaced, adjusted or otherwise manipulated when the user decides to change the setup, i.e., to convert the apparatus for subdivision of the web 4 into shorter or longer sections 16.

It is clear that the improved apparatus is susceptible of many modifications without departing from the spirit of the invention. For example, the density of graduations 27 in the zone b of the disk 26 can exceed the density of graduations in the zone a. This means that the speed of the motor 13 is less while the transducer 36 monitors the graduations in the zone b.

The spacing between neighboring graduations 22 of the disk 21 is identical with the spacing between neighboring graduations 27 in the zone a of the selected disk 26 if the diameters of the knife holders 8 and 9 are identical (this is shown in the drawing). If this is not the case, the spacing between the graduations 22 is not identical with that of graduations 27 in the zone a of the disk 26. The difference between the two spacings is then proportional to the difference between the diameters of the knife holders 8 and 9. However, the spacing of graduations in the zone a of each and every disk 26 is constant regardless of whether or not such spacing matches the spacing of graduations 22 on the disk 21.

It is further clear that the D.C. motor 13 constitutes but one of many types of variable-speed prime movers which can be used to drive one of the knife holders. For example, the electric motor 13 can be replaced with a fluid-operated variable-speed motor (e.g., a hydraulic motor) without departing from the spirit of the invention.

An important advantage of the improved apparatus is that it can be converted from subdivision of a running web, ribbon or strip into shorter sections to subdivisions of such material into longer sections or vice versa with little loss in time, by resorting to rudimentary tools (thus, a screwdriver suffices to remove the screw 34 and to reconnect such screw with the shaft 25 upon replacement of the previously used disk 26 with a different disk), and that the conversion does not necessitate replacement or adjustment of any components of the cutting mechanism proper (namely, the holders 8, 9 and their knives 11, 12) and/or of the means for advancing the web. Furthermore, the person in charge of converting the cutting apparatus need not adjust the transmission (gears 14*a*, 14*b*) between the holders 8, 9 and/or the transmission between the motor M and the disc 21. All adjustments for a change of setup can be carried out by semiskilled or unskilled persons. The apparatus is simply furnished with a requisite supply of spare disks 26, each having a different distribution of graduations in the zone b.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for subdividing a running web of paper or the like into sections of desired length, comprising means for advancing the web lengthwise along a first path at a predetermined speed; rotary cutter means including at least one knife orbiting along an endless second path a portion of which is adjacent said first path so that the knife makes a cut transversely across the running web while moving along said portion of said second path whereby the web yields a succession of discrete sections whose length is a function of the duration of intervals which elapse between successive movements of said knife along said portion of said second path; a variable-speed prime mover for said cutter means; control means for varying the speed of said prime mover during each revolution of said cutter means so as to drive said knife at a first speed which matches said predetermined speed while the knife moves along said portion of said second path and at one of a plurality of different second speeds while the knife moves from and back to said portion of said second path, said control means including means for generating first signals denoting said predetermined speed and means for maintaining the speed of orbital movement of said knife in said portion of said second path at said predetermined speed in response to said first signals, said means for generating said first signals comprising a rotary element having equidistant indicia, means for rotating said element at a speed which is proportional to said predetermined speed and signal generating detector means arranged to monitor said indicia and to transmit said first signals at a constant frequency, said maintaining means including means for respectively generating second and third signals during movement of said knife along said portion of said second path and during movement of said knife from and back to said portion of said second path, said second signals being a function of said first signals and said maintaining means further including means for regulating the speed of said prime mover as a function of said second and third signals, said means for generating said second and third signals including a second rotary element having a first set of equidistant indicia and a second set of indicia, means for rotating said second element in synchronism with said cutter means and transducer means arranged to monitor the indicia of said second element and to respectively transmit said second and third signals on duration of indicia of said first and second sets; and means for adjusting said control means to select the second speed and hence the duration of said intervals, said adjusting means including means for varying said third signals.

2. Apparatus as defined in claim 1, wherein the spacing of indicia on said first element matches the spacing of indicia of said first set.

3. Apparatus as defined in claim 1, wherein said control means further comprises first counter means for said first signals and second counter means for said second and third signals, said regulating means comprising means for respectively accelerating and decelerating said prime mover when the number of signals transmitted to one of said counter means per unit of time respectively exceeds and is less than the number of signals transmitted to the other of said counter means during the same unit of time.

4. Apparatus as defined in claim 3, wherein said prime mover is a D.C. motor and said regulating means comprises amplifier means for said motor.

5. Apparatus as defined in claim 1, wherein said adjusting means comprises at least one spare second rotary element having a second set of indicia whose distribution is different from the distribution of indicia constituting the second set on said first mentioned second element, and means for releasably coupling said first mentioned second element to said cutter means so that said first mentioned second element is readily replaceable with said spare element.

6. Apparatus as defined in claim 5, wherein said elements are disks and said indicia are graduations applied to the respective disks.

7. Apparatus as defined in claim 5, wherein said cutter means further comprises a shaft and said coupling means includes a quick-release coupling separably connecting a selected second rotary element to said shaft in a predetermined angular position.

* * * * *